US006935440B2

(12) United States Patent
Nelson et al.

(10) Patent No.: US 6,935,440 B2
(45) Date of Patent: Aug. 30, 2005

(54) SERVICE RIG WITH TORQUE CARRIER

(76) Inventors: Allan R. Nelson, 10720—141 Street, Edmonton, Alberta (CA), T5M 1S9; Vladimir W. Lacika, 8133—150 Street, Edmonton, Alberta (CA), T5R 1C9

( * ) Notice: Subject to any disclaimer, the term of this patent is extended or adjusted under 35 U.S.C. 154(b) by 47 days.

(21) Appl. No.: 10/632,112

(22) Filed: Aug. 1, 2003

(65) Prior Publication Data

US 2005/0022985 A1 Feb. 3, 2005

(51) Int. Cl.[7] ..... E21B 19/00
(52) U.S. Cl. ..... 175/52; 175/85; 175/203
(58) Field of Search ..... 175/52, 85, 87, 175/203; 166/775.1

(56) References Cited

U.S. PATENT DOCUMENTS 4,251,176 A * 2/1981 Sizer et al. ..... 414/22.71
5,433,279 A * 7/1995 Tessari et al. ..... 173/213
5,501,286 A * 3/1996 Berry ..... 175/52
5,921,329 A * 7/1999 Armstrong ..... 175/57
2004/0129417 A1 * 7/2004 Nelson et al. ..... 166/177.4

* cited by examiner

*Primary Examiner*—William Neuder

(57) ABSTRACT

A service rig, comprising a mast, a torque carrier suspended from the mast; and a brace having a torque carrier end connected to the torque carrier for conveying torque from the torque carrier into the brace and an anchored end with a fastener for attaching the brace to a substructure at a well or the back of the service rig. When the service rig is in operation over a well and has a substructure, the anchored end of the brace is horizontally offset from a point on the substructure directly below the torque carrier end of the brace. The anchored end of the brace, when in operative position, is oriented parallel to an extension of the torque carrier. The anchored end of the brace preferably constitutes an offset extension of the torque carrier. If a substructure is not available, the torque carrier extension may be anchored to the back of the service or workover rig.

4 Claims, 4 Drawing Sheets

SERVICE RIG WITH TORQUE CARRIER

BACKGROUND OF THE INVENTION

To rotate tubing within a well, drilling rigs often have top drives that are suspended from drilling masts. When the top drives rotate the tubing, torque generated by the top drives must be transmitted into the supporting structure. For this purpose, it is conventional to provide a torque tube running along the height of the mast along which the top drive slides. The torque tube is fastened to stabilize its position but not to transmit torque into the mast. In service or workover rigs, which typically transport the mast on the rear of a carrier, the masts are not designed to withstand the torque load generated by a top drive. Thus, a torque tube cannot be attached to the mast in a way that conveys substantial torque into the mast. This invention is intended to overcome this difficulty.

SUMMARY OF THE INVENTION

Therefore, according to an aspect of the invention, there is provided a service or workover rig, comprising a mast, a torque carrier suspended from the mast; and a brace having a torque carrier end connected to the torque carrier for conveying torque from the torque carrier into the brace and an anchored end with a fastener for attaching the brace to the rear of the rig or a substructure of a well. Preferably, when the service rig with substructure is in operation over a well, the anchored end of the brace is horizontally offset from a point on the substructure directly below the torque carrier end of the brace. In a further aspect of the invention, the anchored end of the brace, when in operative position, is oriented parallel to an extension of the torque carrier. The anchored end of the brace preferably constitutes an offset extension of the torque carrier. If a substructure is not used, the brace may be tied into the back of the rig.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the elements is present.

Figure 1:
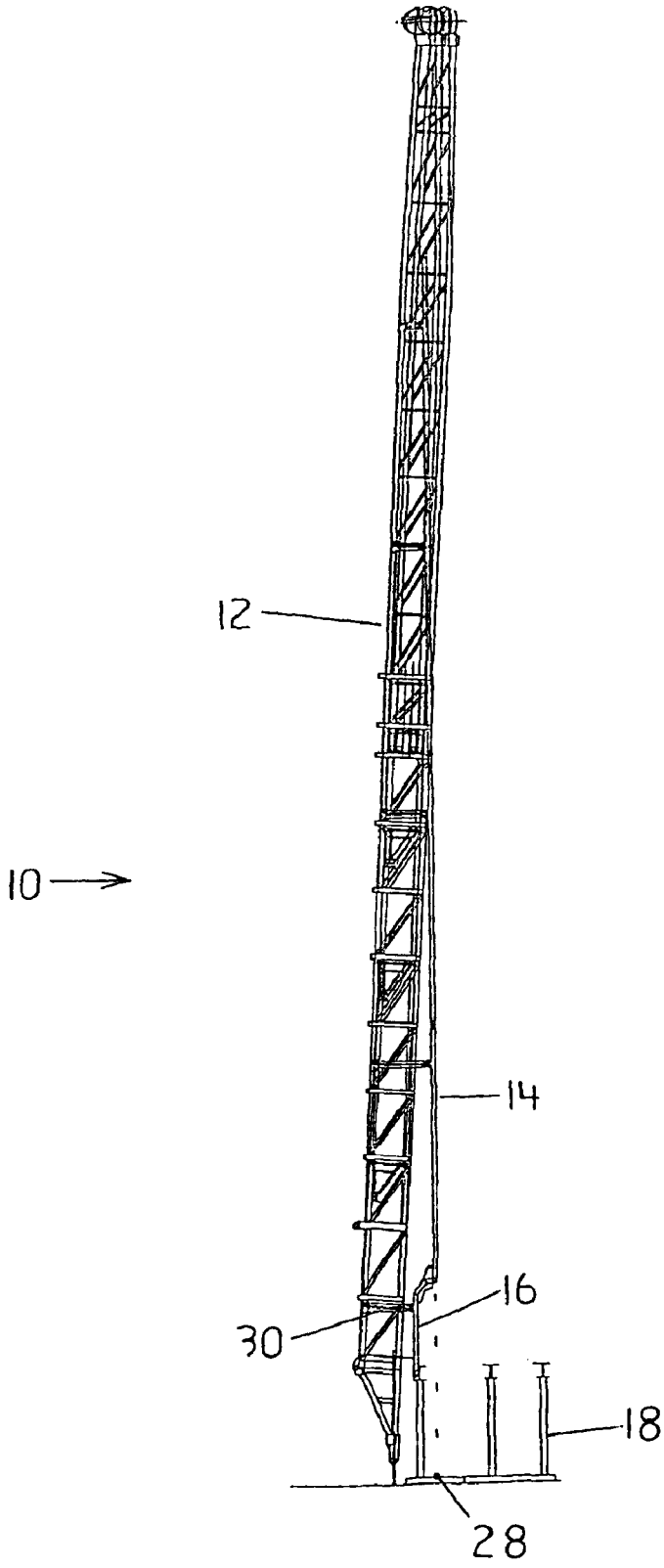
FIG. 1 is a perspective view of a service rig with brace according to the invention.
Figure 2C:
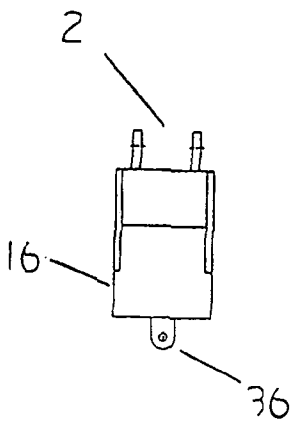
FIGS. 2A, 2B and 2C respectively show a rear view, side view and top view of a brace according to the invention.
Figure 2B:
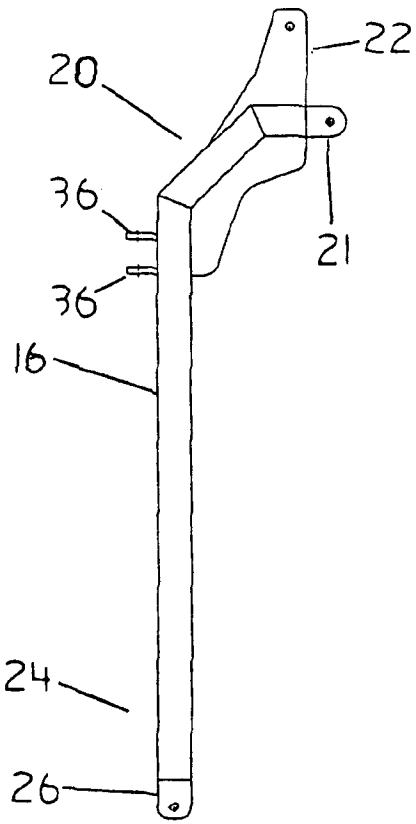
Figure 2A:
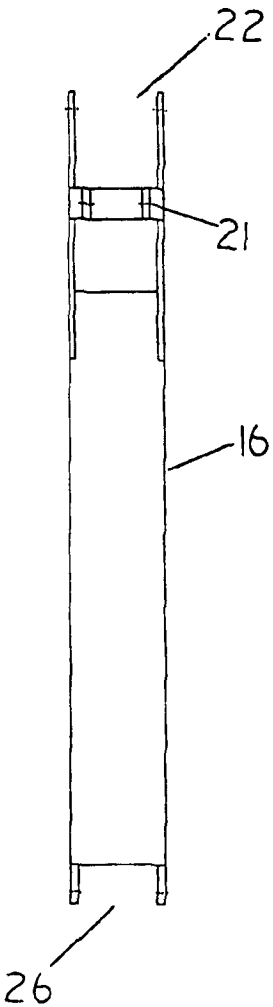
Figure 4:
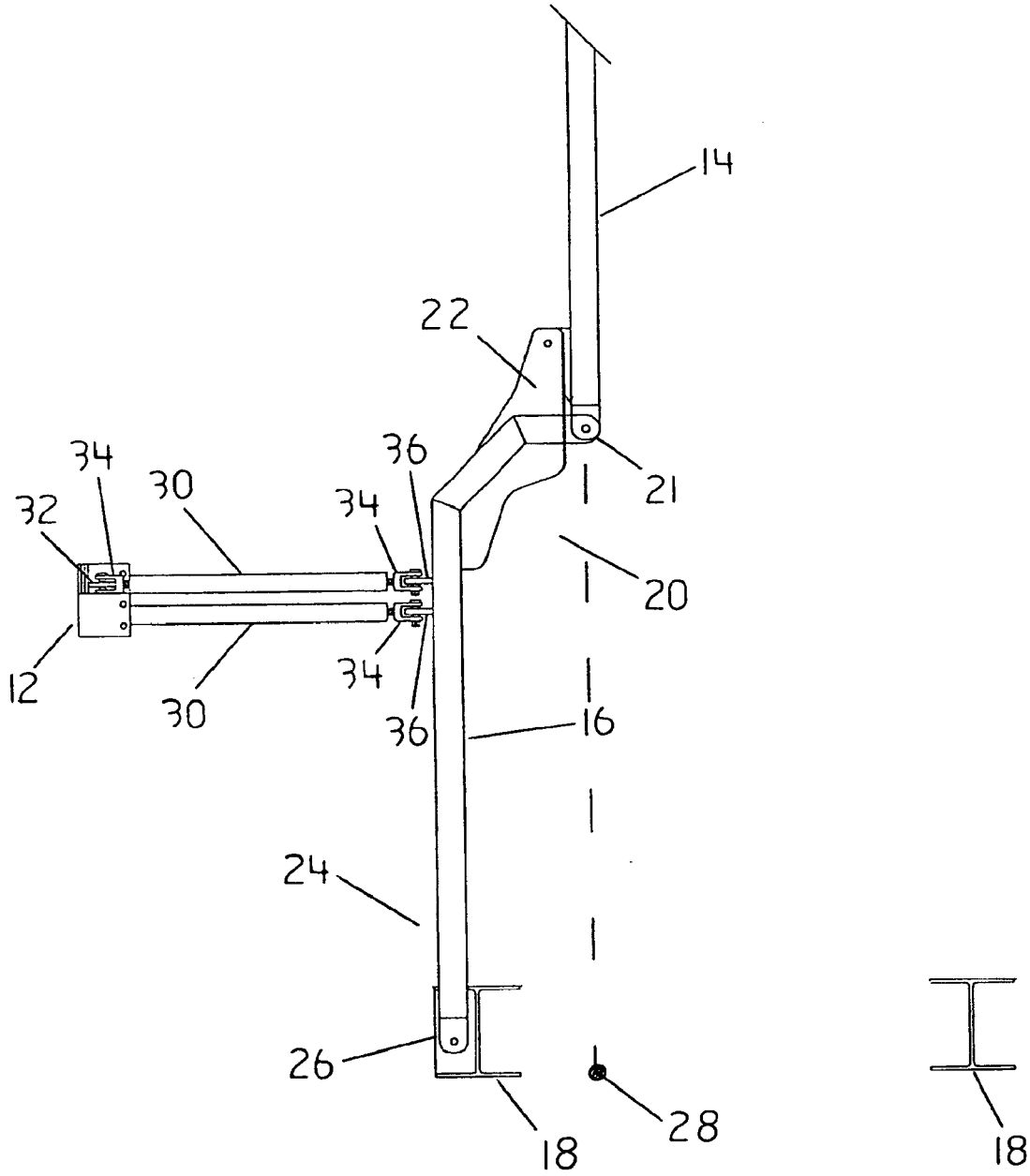
FIG. 4 shows a brace attached to a torque carrier, ties, and the back of a rig or substructure.

As shown in FIG. 1, a service rig 10 has a mast 12 with a torque carrier 14 suspended from the mast 12 in conventional fashion for attaching torque carriers to masts. The joint used for suspending the torque carrier 14 from the mast 12 is not intended to transmit significant torque to the mast 12. However, the torque carrier 14 must be able to resist the torque generated by a top drive. A brace 16 is provided to secure the torque carrier 14 to the back of the rig or a substructure 18 at a well. The brace 16 has a torque carrier end 20 connected for example by clamps 21 and 22 to the torque carrier 14 for conveying torque from the torque carrier 14 into the brace 16. In FIG. 4, the brace 16 has an anchored end 24 with a fastener, for example a clamp 26, for attaching the brace 16 to the substructure 18 of a well or, via an additional support or brace, not shown, to the back of the service or workover rig where the service or workover rig attaches to its carrier. FIGS. 2A, 2B, 2C give different perspectives on the brace 14 and its attachments.

When the mast 12 of a service rig is in operation over a well having a substructure 18, the anchored end 24 of the brace 16 is horizontally offset from a point 28 on the substructure 18 directly below the torque carrier end 20 of the brace 16, as shown in FIG. 4. This allows working room under the torque carrier 14 for the location and operation of tools, and allows the torque carrier 14 to clear a rotary table when it is present. The anchored end 24 of the brace 16, when in operative position, is oriented parallel to an extension of the torque carrier 14. The anchored end 24 of the brace 16 is preferably made of the same materials and same design as the torque carrier 14 and thus preferably constitutes an offset extension of the torque carrier 14. The torque carrier end 20 of the brace 16 accommodates the horizontal offset of the anchored end 24 by inclining towards the torque carrier 14 in a more horizontally oriented section. The torque carrier 14 is preferably formed of multiple section for convenient transport with the service rig.

Figure 3:
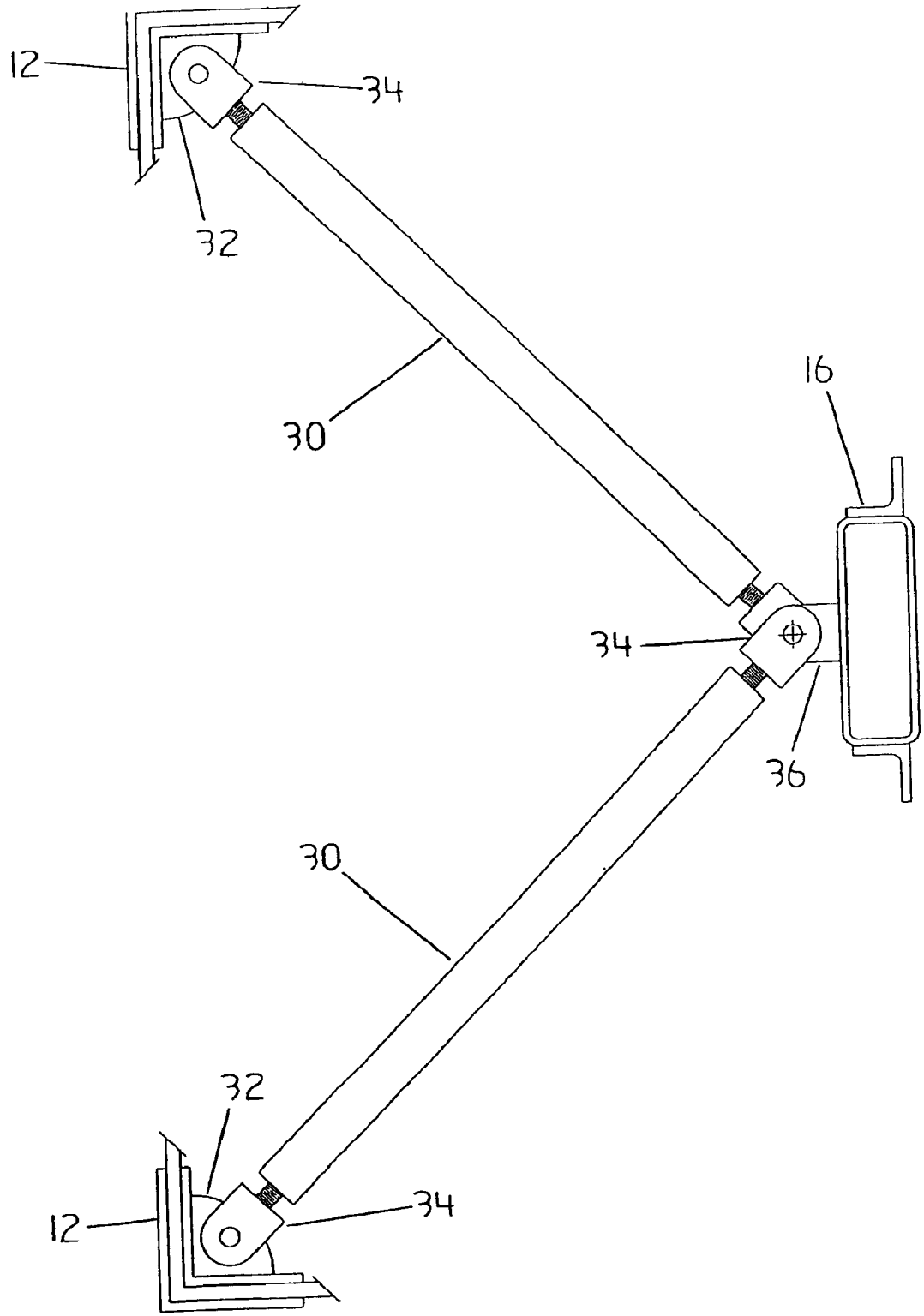
FIG. 3 shows a top view of a set of ties for restraining lateral motion of the brace shown in FIGS. 1, 2A, 2B and 2C.

According to this design of a brace 16, torque generated by a top drive riding on the torque carrier 14 is transmitted through the torque carrier 14 into the substructure 18. As shown in FIG. 3, to prevent lateral motion of the brace 16, it is preferred to provide ties 30 that connect between flanges 32 that are clamped with clamps 34 to the mast 12 and flanges 36 (only one is seen in FIG. 3) on the brace 16. The torque carrier 14 is free to flex about pin 34.

Immaterial modifications may be made to the invention described here without departing from the invention.

What is claimed is:

1. A service or workover rig that is designed for transport to and from a well on the rear of a rig carrier and in operation is attached to the rig carrier and supported over a substructure of the well, the service or workover rig in operation comprising:

a mast supported at an angle to the vertical over the substructure of the well;

a torque carrier suspended from the mast; and a brace having a torque carrier end connected to the torque carrier for conveying torque from the torque carrier into the brace, the brace having an anchored end with a fastener for attaching the brace to the substructure of the well.

2. The service or workover rig of claim 1 in which the anchored end of the brace is horizontally offset from a point on the substructure directly below the torque carrier end of the brace.

3. The service or workover rig of claim 2 in which the anchored end of the brace, when in operative position, is oriented parallel to an extension of the torque carrier.

4. The service or workover rig of claim 1 in which the anchored end of the brace constitutes an offset extension of the torque carrier.

* * * * *